US008842868B1

(12) United States Patent
Hsu Huang et al.

(10) Patent No.: US 8,842,868 B1
(45) Date of Patent: Sep. 23, 2014

(54) STRUCTURE FOR PASSIVE RADIATION SOUND BOX

(71) Applicant: Jazz Hipster Corporation, New Taipei (TW)

(72) Inventors: Yueh-Hua Hsu Huang, New Taipei (TW); Lien-Huang Yang, New Taipei (TW)

(73) Assignee: Jazz Hipster Corporation, New Taipei (TW)

( * ) Notice: Subject to any disclaimer, the term of this patent is extended or adjusted under 35 U.S.C. 154(b) by 0 days.

(21) Appl. No.: 13/926,812

(22) Filed: Jun. 25, 2013

(51) Int. Cl.
*H04R 25/00* (2006.01)

(52) U.S. Cl.
USPC ..... 381/349; 381/345; 381/346; 381/348

(58) Field of Classification Search
USPC ..... 381/345–354
See application file for complete search history.

(56) References Cited

U.S. PATENT DOCUMENTS

| | | | | |
|---|---|---|---|---|
| 3,727,719 | A * | 4/1973 | Yando | 381/349 |
| 4,332,986 | A * | 6/1982 | Butler | 381/349 |
| 4,939,783 | A * | 7/1990 | Dunning | 381/349 |
| 5,432,860 | A * | 7/1995 | Kasajima et al. | 381/349 |

* cited by examiner

*Primary Examiner* — Suhan Ni
(74) *Attorney, Agent, or Firm* — Muncy, Geissler, Olds & Lowe, P.C.

(57) ABSTRACT

An improved structure for a passive radiation sound box comprises: a body, which is formed an inner room and a sound-guide tunnel through several clapboards, the surface of the body is disposed an outlet connecting with the tunnel; a passive radiation component, each of the two ends of a vibration film has an edge, the component is disposed between the clipboards, the edges are connected with the clipboards; and an amplifier unit, which is surrounded in the room by the clapboards and the component, a vibration film of the unit is disposed on a side surface of the room, the component is beneath the unit; wherein while the unit is vibrating and sounding, partial sound pressure in the room is through the room by way of the component, and is then released by the outlet along the tunnel.

8 Claims, 12 Drawing Sheets

STRUCTURE FOR PASSIVE RADIATION SOUND BOX

BACKGROUND OF THE INVENTION

1. Field of the Invention

The present invention generally relates to an improved structure for a passive radiation sound box, more particularly to a sound box that is to solve problems of wind shear and low frequency control caused by reflective sound box and passive radiation sound box.

2. Description of the Prior Art

General speaker unit or amplifier unit is a complex of mass, flexible and damping applications. When a speaker unit in vibration, producing sound waves, the principle is the elasticity of the suspension system. If the speaker unit installed in a sound box, and the sound box has air, air itself has a mass, while the speaker unit generates sound pressure to compress air in the sound box, it is just like that the air marches in the sound box at the state of the pressure wave.

For achieving better effects, passive sound box and reflective sound box are designed, shown as FIGS. 1A and 1B. The closed environment has at least passive element, and a passive element 12 is disposed behind a amplifier unit 11 or on the same plane with the amplifier unit 11, and so will be able to increase the damping effect of a passive sound box 1, and buffer the sound pressure of the passive sound box 1, so that the vibrations of the passive sound box 1 is decreased and the low-frequency effect is promoted while the amplifier unit 11 is sounding.

Another reflective sound box 2 is to dispose an echo tube 22 having an open 221, shown as in FIGS. 2A and 2B. The open 221 is on the same side with the amplifier unit 21 or is not on the same side with the amplifier unit 21. So, when the amplifier monomer 21 is in vibration, the echo tube 22 can squeeze the sound pressure generated due to the air inside the sound box to enhance the sense of bass, in order to make that the reflective sound box 2 is capable of having a good resonance effect.

However, the two sound boxes, passive sound box and reflective sound box, passive components or echo tube must be in good planning and design. For reflective sound box, the sizes, positions and shapes of the opens of the sound box and the echo tube will affect the low frequency changes. If design adverse occurs when designing passive sound box or reflective sound box, the overall efficiency of the sound box and the tone orientation all have a significant impact. Hence, to design the passive sound box and the reflective sound box is particularly complicated and is effectively controlled, thus to achieve the low frequency control is limited as well. In addition to the above-mentioned drawbacks, the problem of wind shear may cause since the control is not easy, and therefore solutions to improve the problems of the passive sound box and the reflective sound box is urgently needed.

However, to design an improved structure for a passive radiation sound box in order to integrate the structural features of a passive sound box and a reflective sound box in order to solve problems of wind shear and low frequency control can be a best solution.

SUMMARY OF THE INVENTION

The main objective of the present invention is to provide an improved structure for a passive radiation sound box, which is to integrate the structural features of a passive sound box and a reflective sound box in order to solve problems of wind shear and low frequency control.

To reach above objective, an improved structure for a passive radiation sound box comprises: a body, which is formed an inner room and a sound-guide tunnel through a plurality of clapboards, the surface of the body is disposed an outlet connecting with the sound-guide tunnel; a passive radiation component, each of the two ends of a vibration film has an edge, the passive radiation component is disposed between the clipboards, the edges of the two ends of the vibration film are connected with the clipboards; and an amplifier unit, which is surrounded in the inner room by the clapboards and the passive radiation component, a vibration film of the amplifier unit is disposed on a side surface of the inner room of the body, the passive radiation component is beneath the amplifier unit; wherein while the amplifier unit is vibrating and sounding, partial sound pressure in the inner room is through the inner room by way of the passive radiation component, and is then released by the outlet along the sound-guide tunnel.

More physically, the sound-guide tunnel has at least one reflective board, the two ends of the reflective board are connected with an inner side surface of the body.

More physically, the vibration film of the amplifier unit is vertical to the passive radiation component.

More physically, the outlet is on the surface of the body where is the same side with the vibration film of the amplifier unit.

Except for above structure, there is another embodiment, which comprises a body, which is formed an inner room and a sound-guide tunnel through a plurality of clapboards, the surface of the body is disposed an outlet connecting with the sound-guide tunnel; a passive radiation component, each of the two ends of a vibration film has an edge, the passive radiation component is disposed between the clipboards, the edges of the two ends of the vibration film are connected with the clipboards; and an amplifier unit, which is surrounded in the inner room by the clapboards and the passive radiation component, a vibration film of the amplifier unit is disposed on a side surface of the inner room of the body, the passive radiation component is after the amplifier unit; wherein while the amplifier unit is vibrating and sounding, partial sound pressure in the inner room is through the inner room by way of the passive radiation component, and is then released by the outlet along the sound-guide tunnel.

More physically, the sound-guide tunnel has at least one reflective board, the two ends of the reflective board are connected with an inner side surface of the body.

More physically, the vibration film of the amplifier unit is parallel to the passive radiation component.

More physically, the outlet is on the surface of the body where is not the same side with the vibration film of the amplifier unit.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1A:
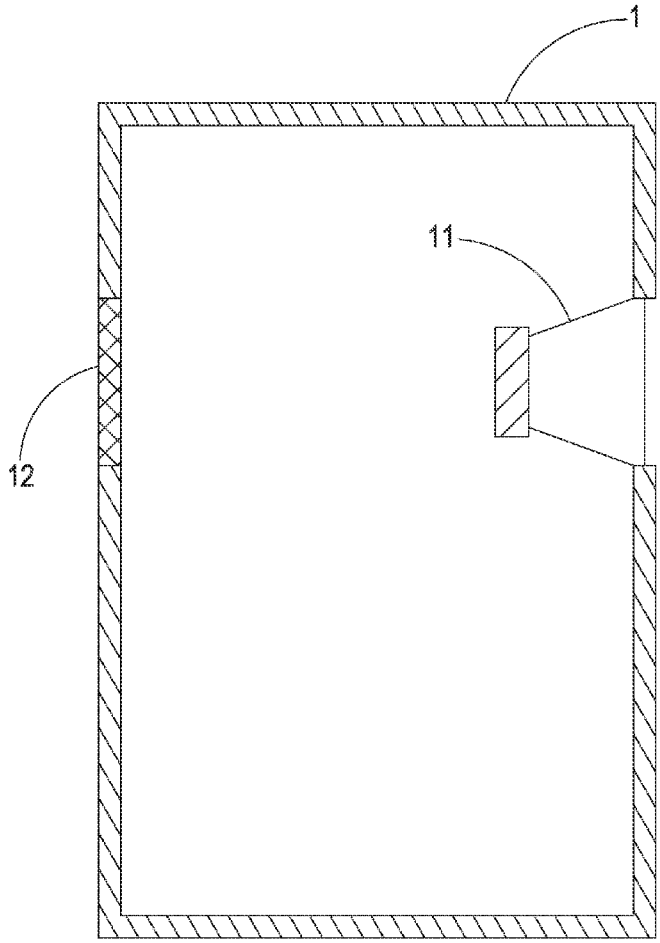
PRIOR ART FIG.1A
FIG. 1A illustrates schematic inner structural view of a prior passive sound box.
Figure 1B:
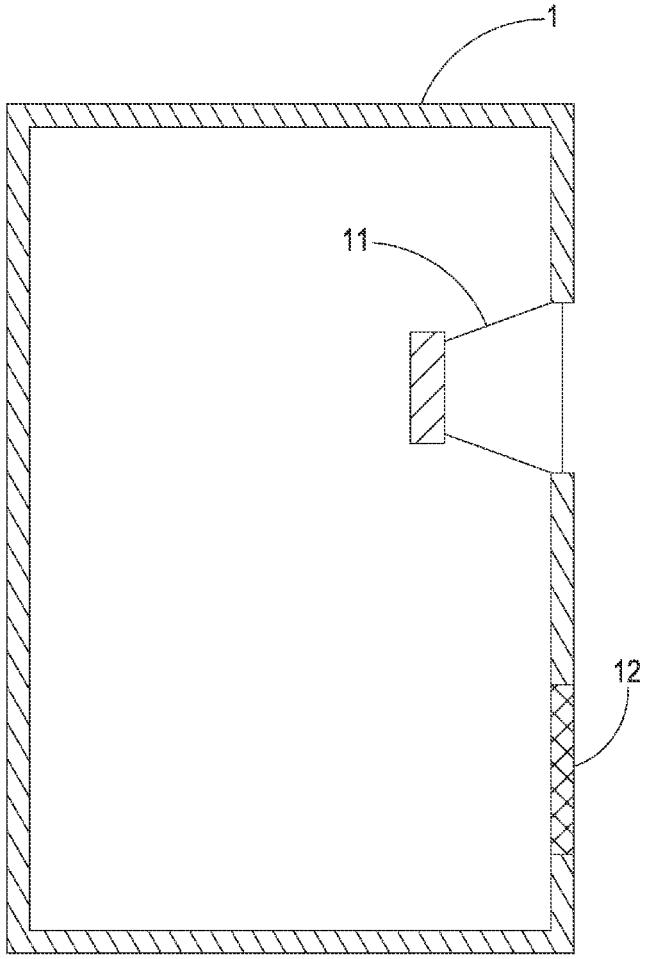
PRIOR ART FIG.1B
FIG. 1B illustrates schematic inner structural view of a prior passive sound box.
Figure 2A:
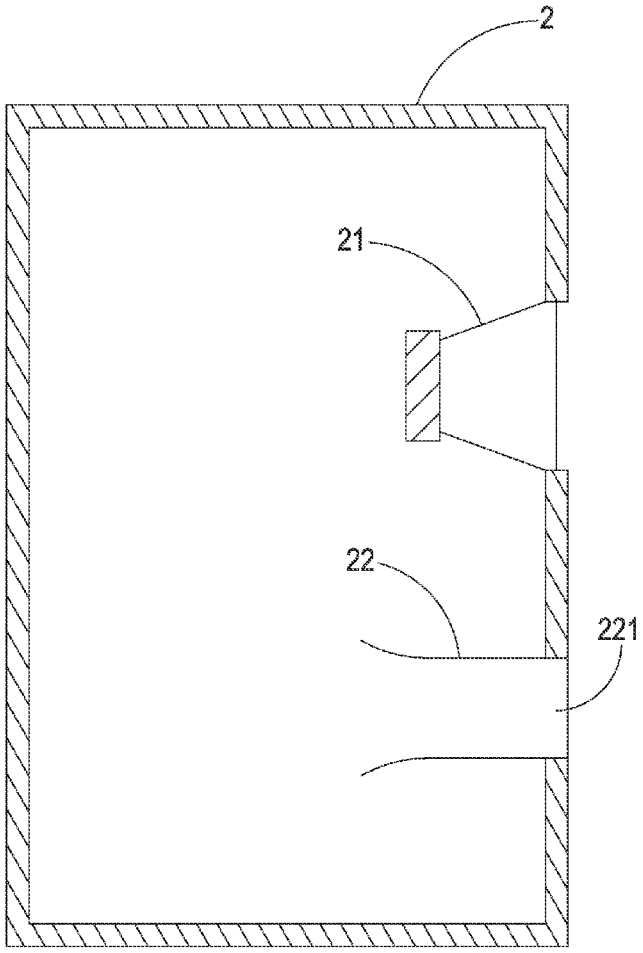
PRIOR ART FIG.2A
FIG. 2A illustrates schematic inner structural view of a prior reflective sound box.
Figure 2B:
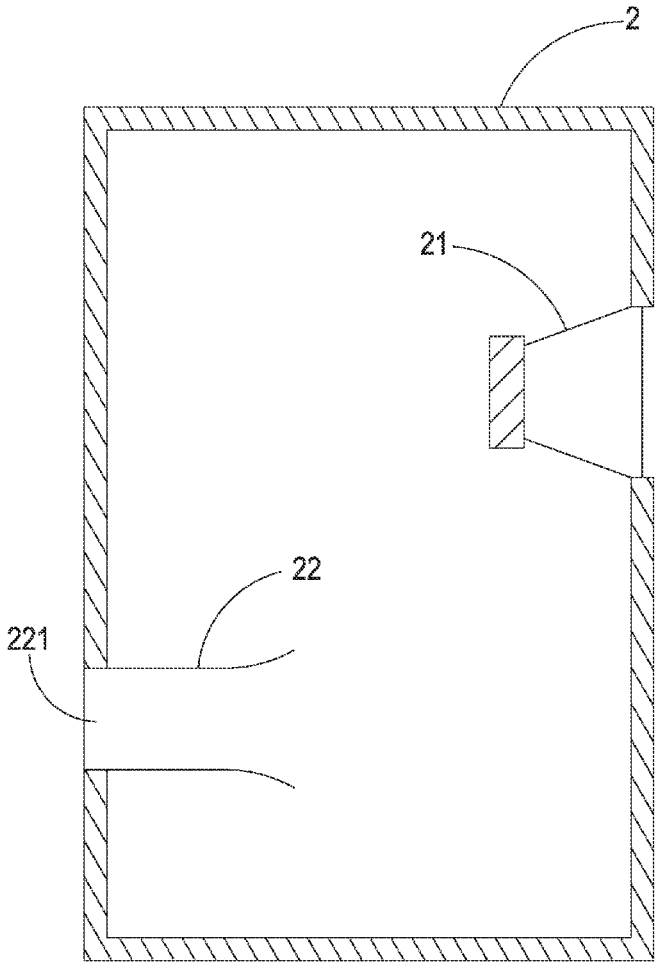
PRIOR ART FIG.2B
FIG. 2B illustrates schematic inner structural view of a prior reflective sound box.
Figure 3A:
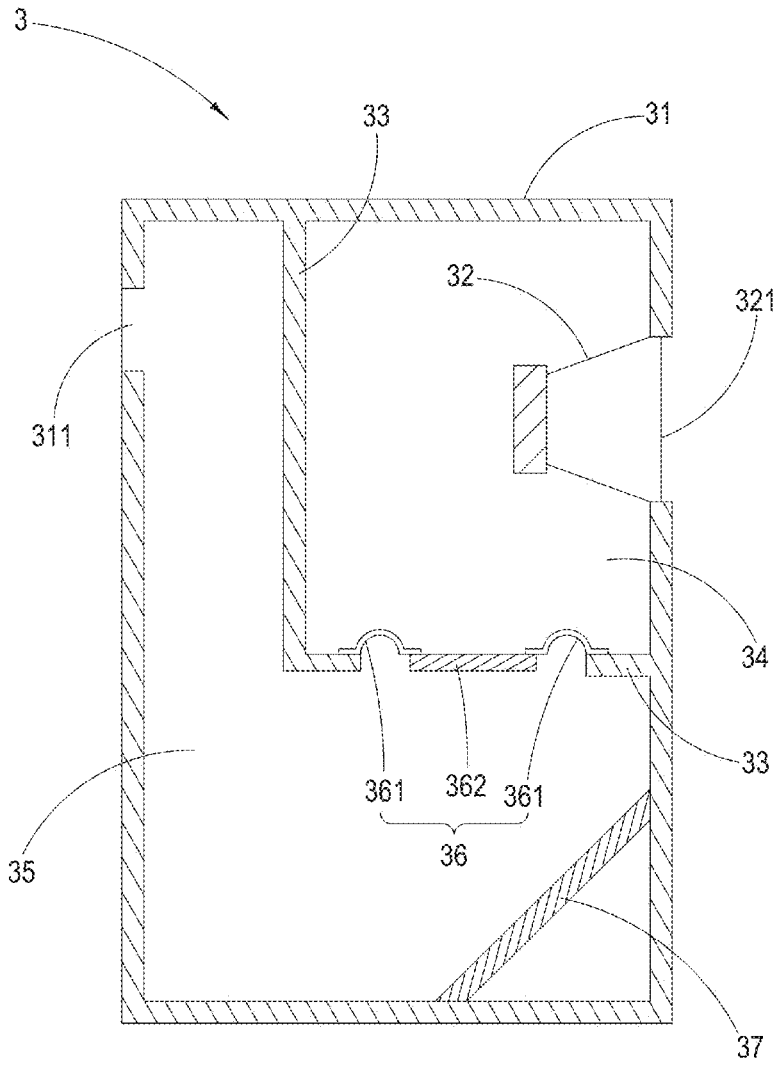
FIG. 3A illustrates a schematic inner structure view of a first preferred embodiment of the improved structure for the passive radiation sound box of the present invention.
Figure 3B:
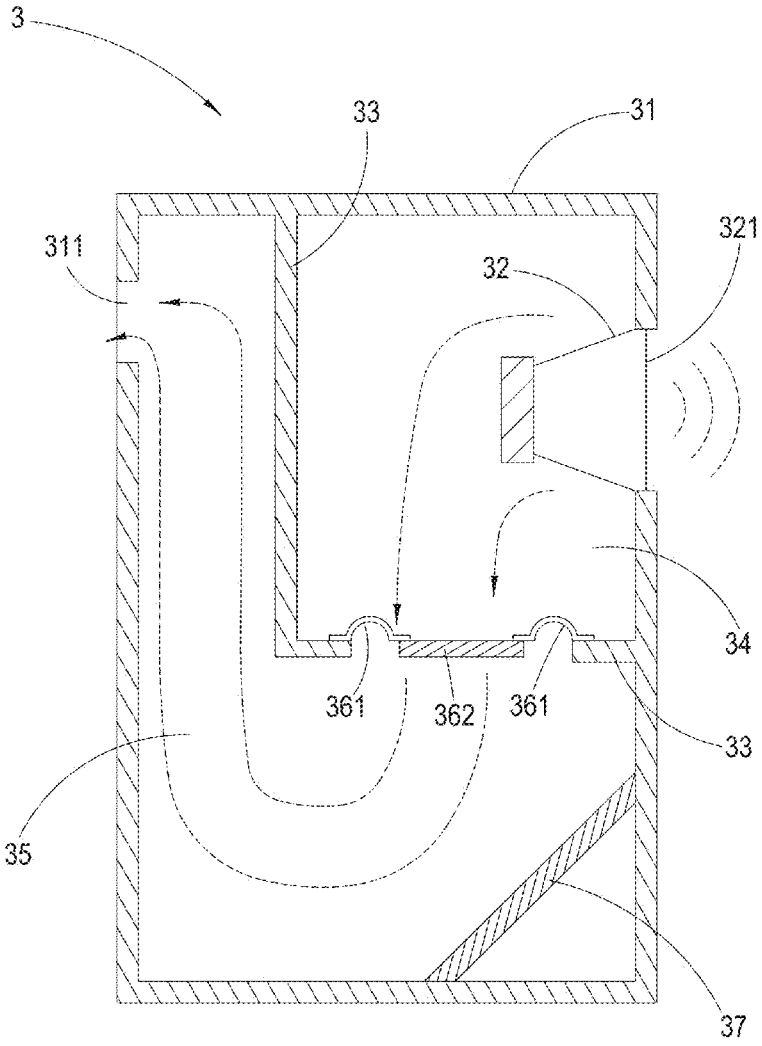
FIG. 3B illustrates a schematic vibrating and sounding view of the first preferred embodiment of the improved structure for the passive radiation sound box of the present invention.

With reference to FIG. 3A, which illustrates a schematic inner structure view of a first preferred embodiment of the improved structure for the passive radiation sound box of the present invention. The sound box 3 has: a body 31, which is formed an inner room 34 and a sound-guide tunnel 35 through a plurality of clapboards 33, the surface of the body 31 is disposed an outlet 311 connecting with the sound-guide tunnel 35, wherein the outlet 311 is on the surface of the body 31 where is not the same side with the vibration film 321 of the amplifier unit 32; a passive radiation component 36, each of the two ends of a vibration film 362 has an edge 361, the passive radiation component 36 is disposed between the clipboards 33, the edges 361 of the two ends of the vibration film 362 are connected with the clipboards 33; and an amplifier unit 32, which is surrounded in the inner room 34 by the clapboards 33 and the passive radiation component 36, since one side surface of the inner room 34, the surface of the body 31, has an open, a vibration film 321 of the amplifier unit 32 is positioned at the open, the vibration film 321 of the amplifier unit 32 is disposed on a side surface of the inner room 34 of the body 31, the passive radiation component 36 being beneath the amplifier unit 32, wherein the vibration film 321 of the amplifier unit 32 is vertical to the passive radiation component 36. With reference to FIG. 3B, which illustrates a schematic vibrating and sounding view of the first preferred embodiment of the improved structure for the passive radiation sound box of the present invention. While the amplifier unit 42 is vibrating and sounding, partial sound pressure in the inner room 44 firstly goes back to touch the passive radiation component 46, the partial sound pressure is through the inner room (44) by way of the passive radiation component 46, and is then released by the outlet 411 along the sound-guide tunnel 45.

With reference to FIG. 3A and FIG. 3B, the sound-guide tunnel 35 of the passive radiation component 36 has at least one reflective board 37, the two ends of the reflective board 37 are connected with an inner side surface of the body 31. Therefore, while the partial sound pressure is transmitted to surrounding by the edges 362 of the passive radiation component 36, the partial sound pressure may be reflected to the sound-guide tunnel 35 by the reflective board 37 for avoiding consumption of the partial sound pressure.

Figure 4A:
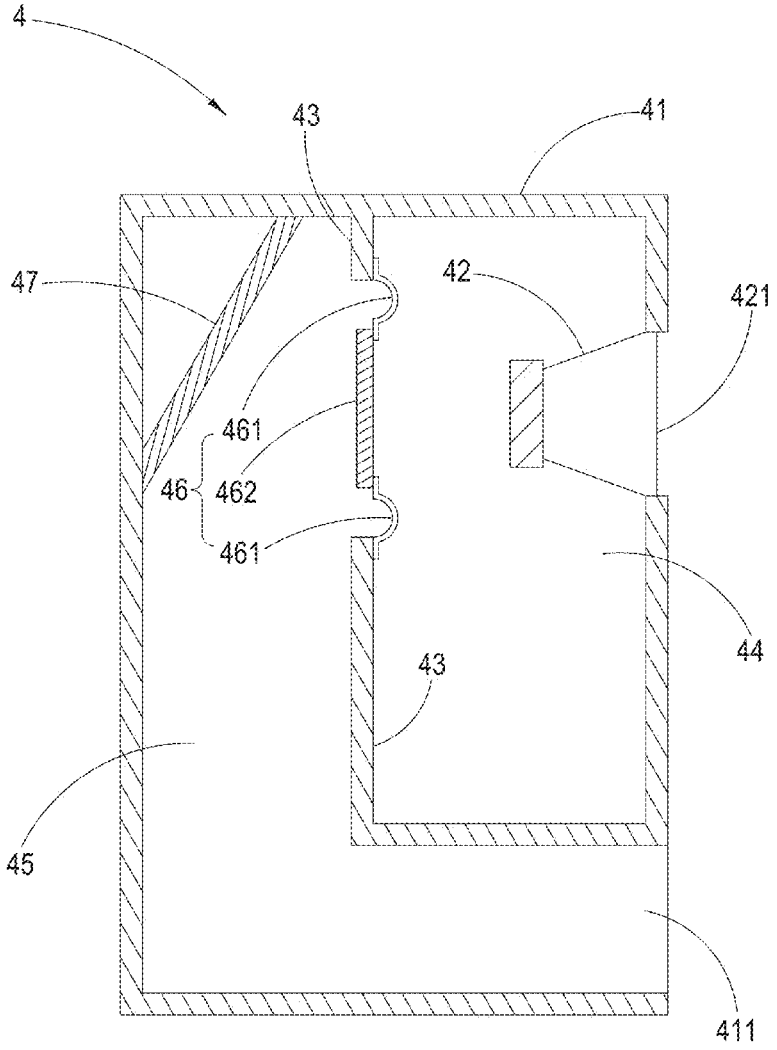
FIG. 4A illustrates a schematic inner structure view of a second preferred embodiment of the improved structure for the passive radiation sound box of the present invention.
Figure 4B:
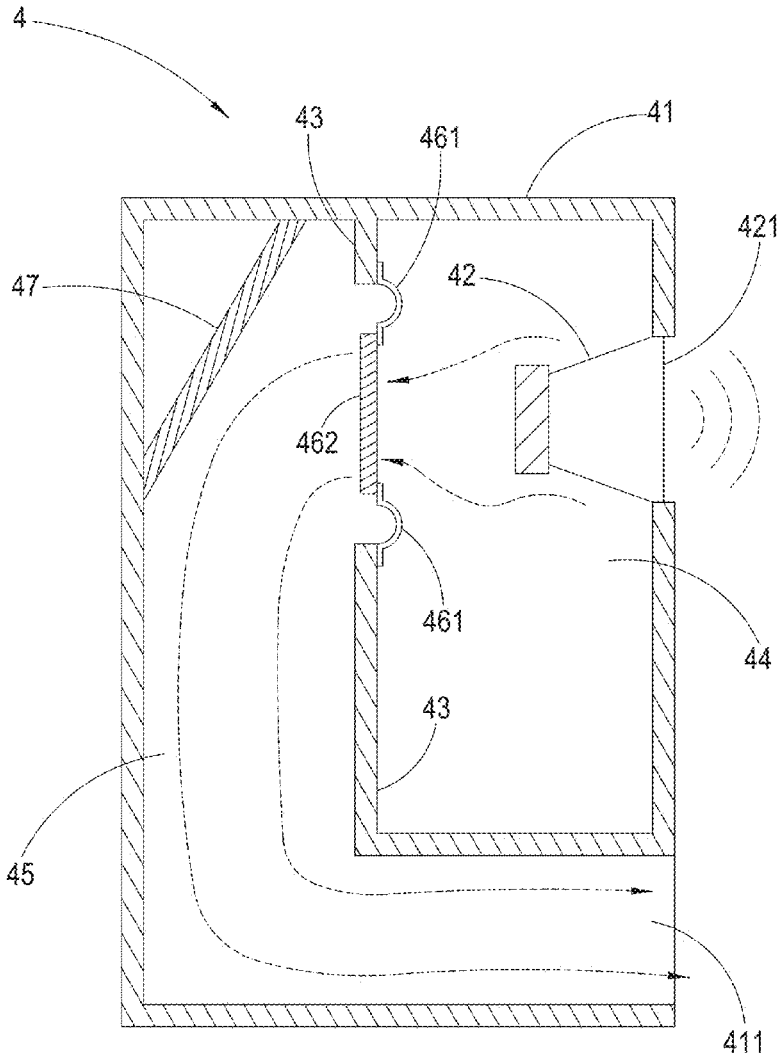
FIG. 4B illustrates a schematic vibrating and sounding view of the second preferred embodiment of the improved structure for the passive radiation sound box of the present invention.

With reference to FIG. 4A and FIG. 4B, which illustrates a schematic inner structure view of a second preferred embodiment of the improved structure for the passive radiation sound box of the present invention and a schematic vibrating and sounding view of the second preferred embodiment of the improved structure for the passive radiation sound box of the present invention. The sound box 4 has a body 41, which is formed an inner room 44 and a sound-guide tunnel 45 through a plurality of clapboards 43, the surface of the body 41 is disposed an outlet 411 connecting with the sound-guide tunnel 45; a passive radiation component 46, each of the two ends of a vibration film 462 has an edge (461), the edges 461 of the two ends of the vibration film 462 are connected with the clipboards 43, the vibration film 421 of the amplifier unit 42 is parallel to the passive radiation component 46, the outlet 411 is on the surface of the body 41 where is the same side with the vibration film 421 of the amplifier unit 42. According to FIG. 4B, while the amplifier unit 32 is vibrating and sounding, partial sound pressure in the inner room 34 firstly goes down to touch the passive radiation component 36, the partial sound pressure is through the inner room (34) by way of the passive radiation component 36, and is then released by the outlet 311 along the sound-guide tunnel 35.

Further, the sound-guide tunnel 45 of the passive radiation component 46 has at least one reflective board 47, the two ends of the reflective board 47 are connected with an inner side surface of the body 41. Therefore, while the partial sound pressure is transmitted to surrounding by the edges 462 of the passive radiation component 46, the partial sound pressure may be reflected to the sound-guide tunnel 45 by the reflective board 47 for avoiding consumption of the partial sound pressure.

Figure 5A:
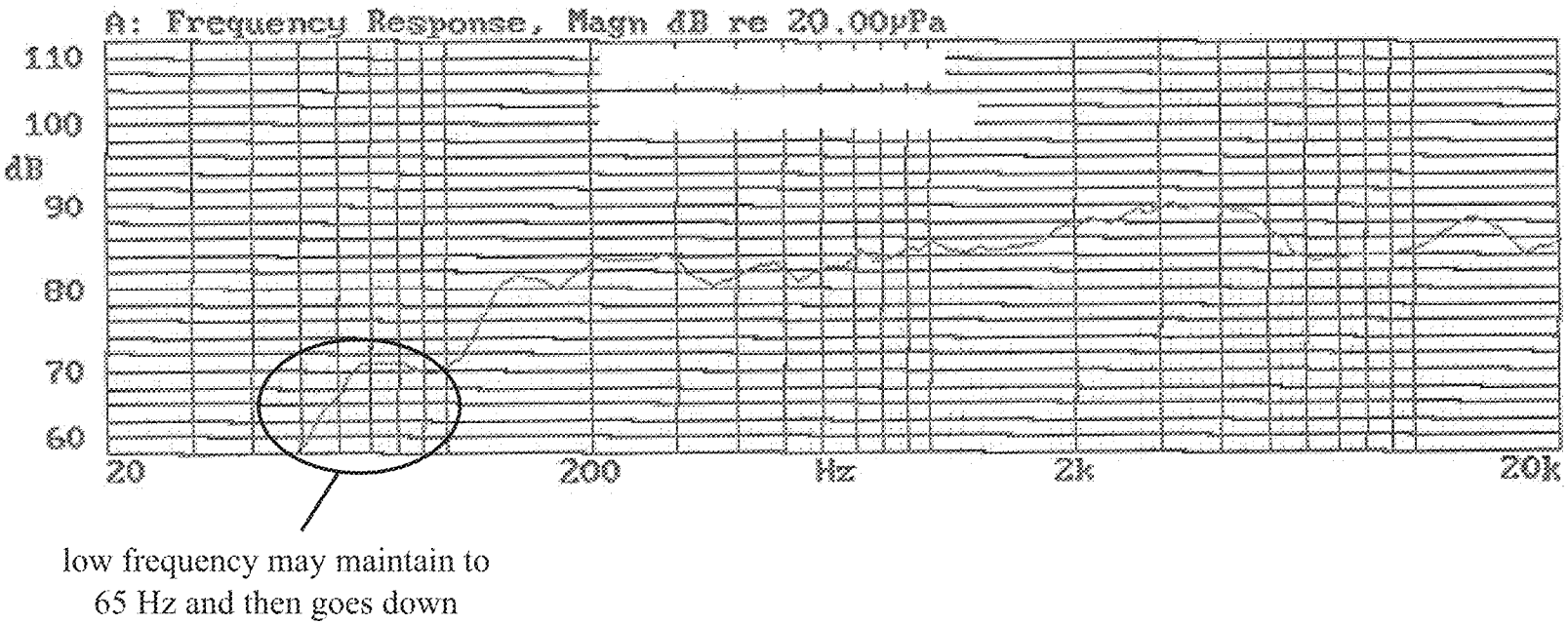
FIG. 5A illustrates a schematic measuring wave view of a sound pressure level (SPL) of the improved structure for the passive radiation sound box of the present invention.
Figure 5B:
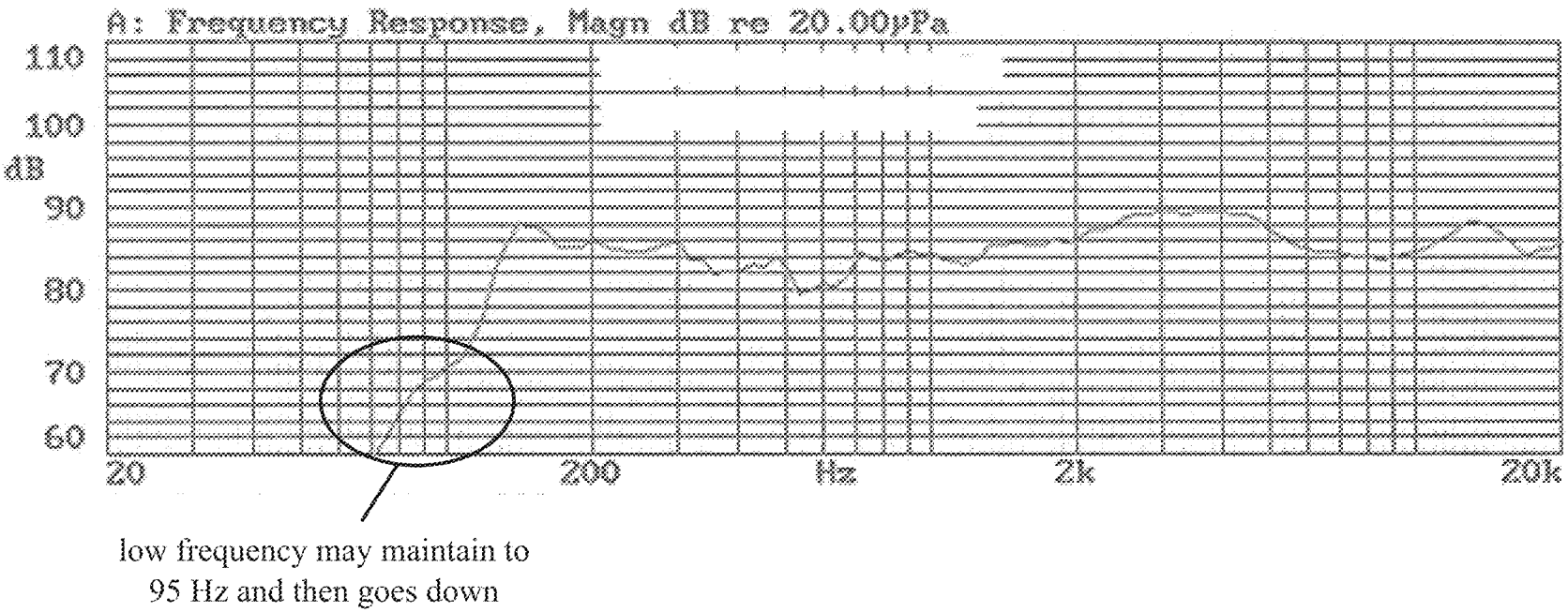
FIG. 5B illustrates a schematic measuring wave view of a sound pressure level of a prior reflective sound box.

With reference to FIG. 5A and FIG. 5B, which illustrate a schematic measuring wave view of a sound pressure level (SPL) of the improved structure for the passive radiation sound box of the present invention and a schematic measuring wave view of a sound pressure level of a prior reflective sound box. The SPL measurement is engaged from a front direction, and the result of the sound pressure level of the improved structure for the passive radiation sound box of the present invention is shown in FIG. 5A, wherein the low frequency may maintain to 65 Hz and then goes down. According to FIG. 5B, the low frequency may maintain to 95 Hz and then goes down. Therefore, a general prior reflective sound box is worse than the passive radiation sound box of the present invention at the aspect of the control stability and the extension while in low frequency.

Figure 6A:
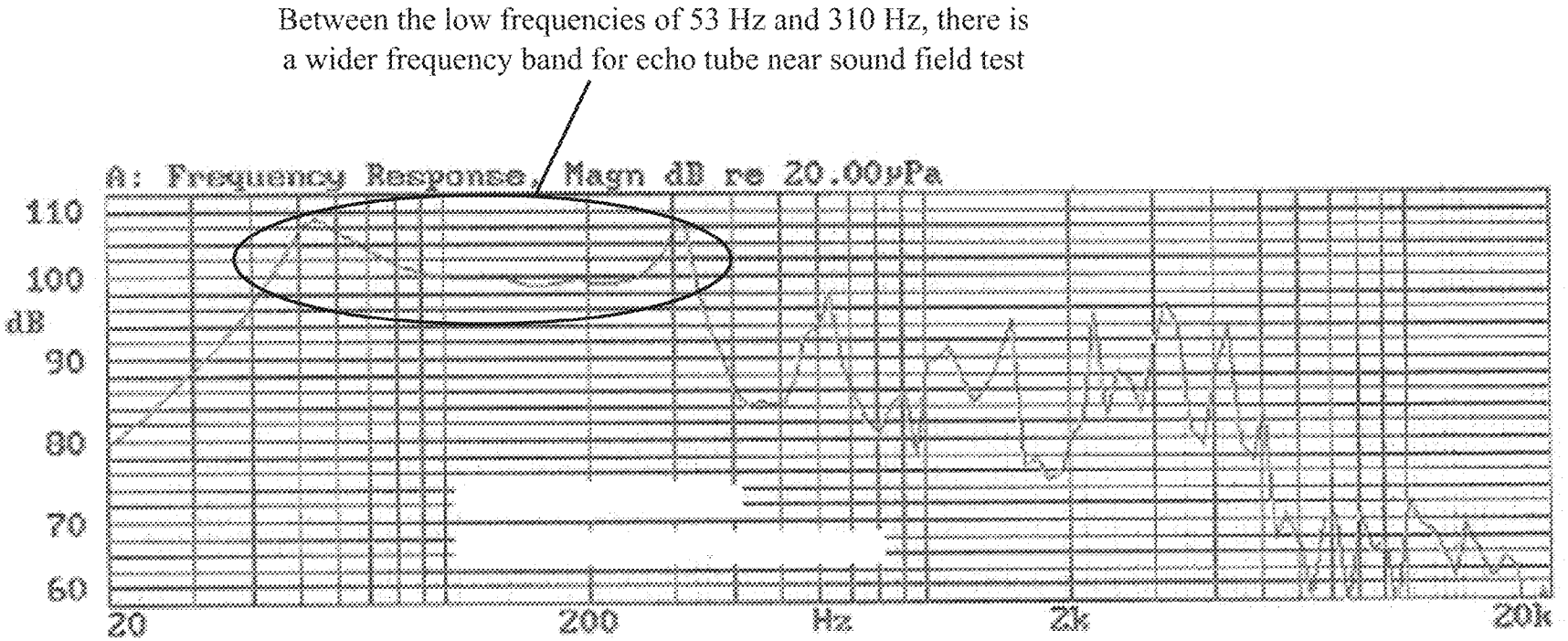
FIG. 6A illustrates a wave view of an outlet of the sound pressure level of the improved structure for the passive radiation sound box of the present invention.
Figure 6B:
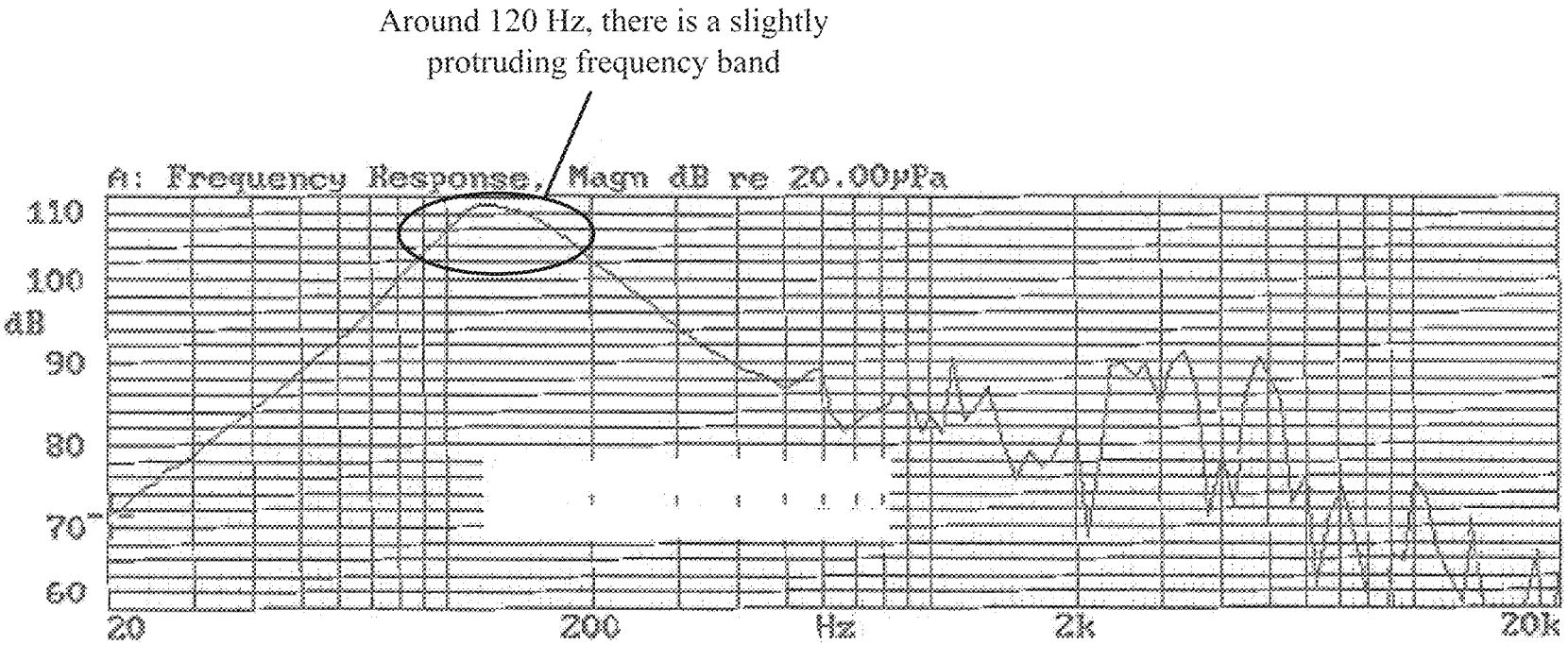
FIG. 6B illustrates a wave view of an echo tube of the sound pressure level of a prior reflective sound box.

In addition to measuring the sound pressure level (SPL) from front direction, a near sound field test can be made around the outlet of the improved structure for the passive radiation sound box of the present invention. As shown in FIG. 6A, which illustrates a wave view of the outlet of the sound pressure level of the improved structure for the passive radiation sound box of the present invention. Between the low frequencies of 53 Hz and 310 Hz, there is a wider frequency band. On the other hand, as shown in FIG. 6B, which illustrates a wave view of an echo tube of the sound pressure level of a prior reflective sound box. Around 120 Hz, there is a slightly protruding frequency band. Hence, Compared to the prior reflective sound box, the response in low frequency of the present invention are better.

With comparison to prior arts, the improved structure for the passive radiation sound box of the present invention has following advantages listed below:

1. The present improved structure for the passive radiation sound box is to integrate the structural features of a passive sound box and a reflective sound box in order to solve problems of wind shear and low frequency control.
2. The present invention transmits the partial sound pressure in the inner room by means of the passive radiation component, and the partial sound pressure then passes through the sound-guide tunnel and the outlet to surrounding. So that, the problem to low frequency control is solved.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. An improved structure for a passive radiation sound box comprising:

a body, which is formed an inner room and a sound-guide tunnel through a plurality of clapboards, the surface of the body being disposed an outlet connecting with the sound-guide tunnel;

a passive radiation component, each of the two ends of a vibration film having an edge, the passive radiation component being disposed between the clipboards, the edges of the two ends of the vibration film being connected with the clipboards; and an amplifier unit, which is surrounded in the inner room by the clapboards and the passive radiation component, a vibration film of the amplifier unit being disposed on a side surface of the inner room of the body, the passive radiation component being beneath the amplifier unit;

wherein while the amplifier unit is vibrating and sounding, partial sound pressure in the inner room being through the inner room by way of the passive radiation component, and being then released by the outlet along the sound-guide tunnel.

2. The improved structure for the passive radiation sound box according to claim 1, wherein the sound-guide tunnel has at least one reflective board, the two ends of the reflective board being connected with an inner side surface of the body.

3. The improved structure for the passive radiation sound box according to claim 1, wherein the vibration film of the amplifier unit is vertical to the passive radiation component.

4. The improved structure for the passive radiation sound box according to claim 1, wherein the outlet is on the surface of the body where is not the same side with the vibration film of the amplifier unit.

5. An improved structure for a passive radiation sound box comprising:

a body, which is formed an inner room and a sound-guide tunnel through a plurality of clapboards, the surface of the body being disposed an outlet connecting with the sound-guide tunnel;

a passive radiation component, each of the two ends of a vibration film having an edge, the passive radiation component being disposed between the clipboards, the edges of the two ends of the vibration film being connected with the clipboards; and an amplifier unit, which is surrounded in the inner room by the clapboards and the passive radiation component, a vibration film of the amplifier unit being disposed on a side surface of the inner room of the body, the passive radiation component being after the amplifier unit;

wherein while the amplifier unit is vibrating and sounding, partial sound pressure in the inner room being through the inner room by way of the passive radiation component, and being then released by the outlet along the sound-guide tunnel.

6. The improved structure for the passive radiation sound box according to claim 5, wherein the sound-guide tunnel has at least one reflective board, the two ends of the reflective board being connected with an inner side surface of the body.

7. The improved structure for the passive radiation sound box according to claim 5, wherein the vibration film of the amplifier unit is parallel to the passive radiation component.

8. The improved structure for the passive radiation sound box according to claim 5, wherein the outlet is on the surface of the body where is the same side with the vibration film of the amplifier unit.

* * * * *